US009243470B2

(12) United States Patent
Ribble et al.

(10) Patent No.: US 9,243,470 B2
(45) Date of Patent: Jan. 26, 2016

(54) DOWNHOLE SYSTEM AND METHOD FOR FACILITATING REMEDIAL WORK

(71) Applicant: Peak Completion Technologies, Inc., Midland, TX (US)

(72) Inventors: Bobby Ribble, Oklahoma City, OK (US); William Sloane Muscroft, Midland, TX (US)

(73) Assignee: Peak Completion Technologies, Inc., Midland, TX (US)

( * ) Notice: Subject to any disclaimer, the term of this patent is extended or adjusted under 35 U.S.C. 154(b) by 206 days.

(21) Appl. No.: 13/652,300

(22) Filed: Oct. 15, 2012

(65) Prior Publication Data

US 2014/0102722 A1 Apr. 17, 2014

(51) Int. Cl.

| | |
|---|---|
| ***E21B 33/12*** | (2006.01) |
| ***E21B 33/13*** | (2006.01) |
| ***E21B 34/14*** | (2006.01) |

(52) U.S. Cl.

CPC ..... *E21B 33/12* (2013.01); *E21B 33/13* (2013.01); *E21B 34/14* (2013.01)

(58) Field of Classification Search

USPC ..... 166/386, 380, 373, 377, 332.1, 332.4, 166/332.8, 334.1, 188; 175/171

See application file for complete search history.

(56) References Cited

U.S. PATENT DOCUMENTS

| | | | | |
|---|---|---|---|---|
| 2004/0221997 | A1* | 11/2004 | Giroux et al. | 166/380 |
| 2007/0084605 | A1* | 4/2007 | Walker et al. | 166/313 |
| 2009/0090508 | A1* | 4/2009 | Brouse | 166/289 |

* cited by examiner

*Primary Examiner* — David Bagnell
*Assistant Examiner* — Taras P Bemko

(57) ABSTRACT

A downhole system and related method, which may be used in an injection well for permitting removal, repair and or replacement of equipment installed in the well without unloading the formation in which the well is placed. The system generally includes an annulus sealing device, such as a packer, at least one valve, such as a flapper valve, a latching assembly and a rigid elongate member. The rigid elongate member may be connected to the latching assembly and serves the valve to open and close, or be permitted to open and close. The latching assembly serves to disconnect, and subsequently reconnect, equipment from the annular sealing device. Such release is accompanied by closure of the at least one valve and reconnection by opening of the at least one valve. The latching assembly has seals to prevent fluid from flowing around the latching assembly when the valve is open.

20 Claims, 5 Drawing Sheets

DOWNHOLE SYSTEM AND METHOD FOR FACILITATING REMEDIAL WORK

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND

1. Field of the Invention

The present invention relates to oil and natural gas production. More specifically, the system facilitates the introduction of a fluid under pressure into a wellbore and then sealing the wellbore below a desired depth to prevent egress of the introduced fluids while allowing removal of a portion of a work string from the wellbore.

2. Description of the Related Art

In oil and gas wells, it may be desirable to inject a fluid into the well to enhance production of hydrocarbons. For example, steam, carbon dioxide, water or other fluids may be injected into the well to maintain reservoir pressure or heat the oil to lower its viscosity.

Gas injection is one common approach in enhanced oil recovery, and may use carbon dioxide, natural gas, or nitrogen. When the subject gas is injected, the phase behavior of the mixture of gas and crude causes the desired oil displacement, swelling, or a reduction in the surface tension of the oil with the surrounding formation. Each of these makes the oil easier to produce for the formation.

Enhanced oil recovery using gas injection can present some additional problems. For example, in the event of mechanical problems with equipment already in use with the well (e.g., the pump above the system fails, a tubing leak develops, etc.), the entire tubing string may have to be removed and the operator may have to flow down the well, resulting in significant delay and expense from the well flow down. Moreover, removal of the entire tubing string potentially negates any benefits from the prior fluid introduction, because such introduced fluids would be allowed to egress through the wellbore to the surface when the tubing string is removed.

BRIEF SUMMARY

The present invention addresses the problems such as those identified above by allowing the well operator to remove only a portion of the tubing string and inhibiting the egress of introduced fluids while the portion of the tubing string is removed. For example, in the event of pump failure during injection procedures, an embodiment of the system may be used to pull tubing with the pump attached while isolating flow and pressure from the wellbore below a position. The present invention may be used in either a cased or open wellbore.

An embodiment of the system comprises an annulus sealing device having a flow path therethrough, a first side, and a second side; a latch element positioned at the first side of the annulus sealing device; at least one check valve assembly positioned at the second side of the annulus sealing device, the at least one check valve assembly having an annular seat, a seat-engaging element rotatably movable relative to the annular seat, and a biasing member urging the seat-engaging element toward the annular seat; a rigid elongate member extending at least partially through said latch element and having a first end, a second end, and an outer surface extending between the first end and the second end; and a fluid communication path between the annular seat and through the latch element and at least partially defined by the rigid elongate member.

DETAILED DESCRIPTION OFVARIOUS EMBODIMENTS

When used with reference to the figures, unless otherwise specified, the terms "upwell," "above," "top," "upper," "downwell," "below," "bottom," "lower," and like terms are used relative to the direction of normal production and/or flow of fluids and/or gas through the tool and wellbore. Thus, normal production results in migration through the wellbore and production string from the downwell to upwell direction without regard to whether the tubing string is disposed in a vertical wellbore, a horizontal wellbore, or some combination of both. Similarly, during the fracing process, fracing fluids and/or gasses move from the surface in the downwell direction to the portion of the tubing string within the formation.

Figure 1:
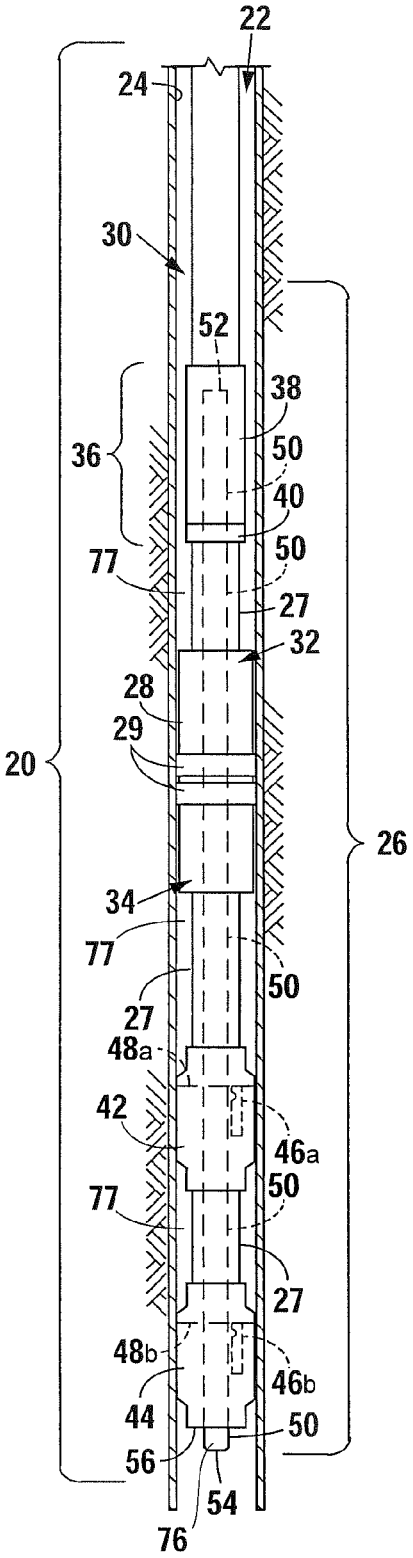
FIG. 1-3 are system diagrams of an embodiment of the present invention in various configurations within a wellbore.

FIG. 1 shows an embodiment of the system disposed in a section 20 of a vertical wellbore 22 having a generally cylindrical sidewall 24. While FIG. 1 shows the system disposed in a vertical configuration, the system may also be used in a wellbore having a non-vertical orientation, such as a lateral wellbore.

The embodiment comprises a section 26 of a tubing string comprising various downhole tools separated by tubing segments 27. The section 26 includes an annulus sealing device, such as a packer 28, which is set into the sidewall 24 and is in an expanded state to isolate the volume of the wellbore 22 below the packer 28 from the volume above the packer 28. The sealing elements 29 of the packer 28 inhibit pressure and fluids from flowing upwell past the packer 28 through the annulus 30 between the sidewall 24 and the various elements composing the tubing string section 26. The packer 28 has a mandrel defining a flow path, a first, upwell side 32 and a second, downwell side 34. During completion or production, fluid may flow through the mandrel of the packer 28 in either the downwell direction or the upwell direction. In the described embodiment, the packer 28 is a JetSet 1-X double grip mechanical set retrievable packer, available from Peak Completion Technologies, Inc. of Midland, Tex.

A tubing disconnect device 36 is positioned in the tubing string section 26 on the upwell side 32 of the packer 28. The tubing disconnect device 36 is more specifically an on/off tool that includes a latch receiving element, such as an overshot 38, a latch element, such as a slick joint 40, and sealing elements (not shown) to inhibit fluid flow through the device 36 when the latch element 40 is engaged with the latch receiving element 38. More specifically, in the described embodiment, the overshot 38 is a J-2 On Off Tool Overshot, and the slick joint 40 is a J-2 On Off Tool Slick Joint, both available from Peak Completion Technologies, Inc. of Midland, Tex. While shown separated by a tubing segment 27, the tubing disconnect device 36 may also be threaded directly to the first side 32 of the packer 28. In alternative embodiments, the tubing disconnect device 36 may be a landing element in combination, and engageable, with a second element having a landing shoulder.

First and second check valve assemblies, such as flapper assemblies 42, 44, are positioned within the tubing string section 26 on the second side 34 of the packer 28. Each flapper valve assembly includes a flapper plate 46*a*, 46*b* rotatable relative to an annular seat 48*a-b* between a closed position and an opened position. In the closed position, the flapper plates 46*a-b* are sealed against the corresponding seat 48*a*, 48*b* to inhibit fluid flow through the flapper assemblies 42, 44 in the upwell direction. Biasing members (not shown), such as torsion springs, urges the flapper plates 46*a-b* of each flapper assembly 42, 44 toward the closed position. When in a closed position, fluid flow in the downwell direction exerts a pressure on the flapper plates 46*a*, 46*b*, and will overcome the forces of any natural well pressure and the corresponding biasing members at or above a known threshold pressure. The rotational force exerted by the corresponding spring is a function of the spring characteristics.

A rigid elongate member, such as a flow tube 50, is connected to the latch receiving member 38 of the tubing disconnect device 36, and extends through the latch element 40 to an operating position. The flow tube 50 of the described embodiment is a generally rigid tubular member having a first end 52, a second end 54, and a cylindrical outer surface 76.

The flow tube 50 extends from the latch receiving member 38 through tubing segments 27, the packer 28, and the flapper assemblies 42, 44. The second end 54 of the flow tube 50 is positioned approximately two inches below the lower annular surface 56 of the lower flapper assembly 44, with the flow tube 50 extending through each of the annular seats 48*a-b*. The first end 52 is connected to the overshot 38 and can receive fluid, such as carbon dioxide, therefrom and direct the received fluid to the second end 54 of the flow tube 50. Because the flow tube 50 is positioned through the flapper assemblies 42, 44, the flapper plates 46*a*, 46*b* cannot rotate to a closed position under the force of the associated springs and are in opened states. An annular space 77 extends from the lower annular surface 56 of the lower flapper assembly 44 to the overshot 38, and is partially defined by the cylindrical outer surface 76 and the inner surfaces of the tubing segments 27, packer 28, and first and second check valves 42, 44.

In the described embodiment, the flow tube 50 is steel, but may be made of any material strong enough to mechanically push open the flapper plates 46*a*, 46*b* and that is also able to withstand the downhole environment. Alternative materials include, but are not limited to, cheap steel, fiberglass, and premium high strength corrosion-resistant materials.

The embodiment may be installed in the well in at least two ways. First, the embodiment may be run into the wellbore 22 in the state described in FIG. 1—that is, the flow tube 50 is connected to the overshot 38 of the tubing disconnect device 36 and disposed through the packer 28 and the annular seats 48*a-b* of the upper and lower flapper assemblies 42, 44. The presence of the flow tube 50 through the seats 48*a-b* prevents the flapper plates 46 from completely closing under the force of the springs and sealing against the seats 48*a-b*. The packer 28 is then set in the desired position within the wellbore 22.

In the event remedial work on part or all of the equipment or well becomes necessary during or after the injection procedure, the well operator may then disconnect the slick joint 40 from the overshot 38. The overshot 38 and flow tube 50 may then be removed from the wellbore 22, leaving the packer 28, flapper assemblies 42, 44, and various tubing segments 27 in the wellbore 22. As the flow tube 50 is removed from the flapper valves 42, 44, the flapper plates 46*a-b* seal against the seats 48*a-b* to inhibit migration of pressure up the wellbore 22 through the flapper assemblies 42, 44, the flow path of the packer 28, and the slick joint 40. Sealing elements 29 of the packer 28 isolates the wellbore annulus 30 and resists movement urged by the force of wellbore pressures acting on the flapper plates 46*a-b* of the flapper assemblies 42, 44. The remedial work can then be performed, and the flow tube 50 reinserted into the wellbore (and the overshot 38 reconnected to the slick joint 40) without having to snub.

In an alternative installation procedure, the packer 28 and flapper assemblies 42, 44 are run into the wellbore 22, and the packer 28 set at the desired depth. The flow tube 50 would be connected to the overshot 38 with any additional desired tools positioned in the tubing string above the overshot 38. The overshot 38 and flow tube 50 would then be run into the wellbore 22. As the second end 54 of the flow tube 50 reaches the flapper assemblies 42, 44, the second end 54 contacts the flapper plates 46 and overcomes the closing force of the spring, causing the flapper plates 46*a-b* to open, thus allowing production from or injection into the wellbore 22 through the flow tube 50. The overshot 38 latches on to, and seals with, the slick joint 40 to anchor and seal the system.

Figure 2:
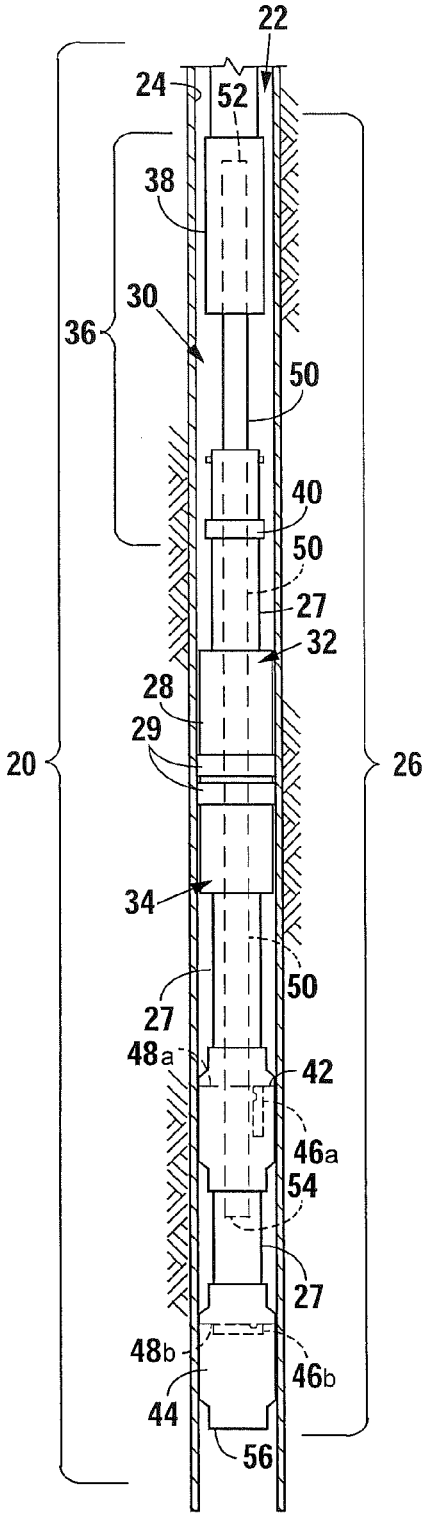

FIG. 2 shows the system described with reference to FIG. 1 with the overshot 38 disconnected from, and positioned a distance upwell of the slick joint 40. The second end 54 of the flow tube 50 is positioned above the lower flapper assembly 44, which allows the associated flapper plate 46*b* to close under the force of the spring. Because the second end 54 of the flow tube 50 has not been moved through the upper flapper valve 42, the corresponding flapper plate 46*a* remains in an unclosed position.

Figure 3:
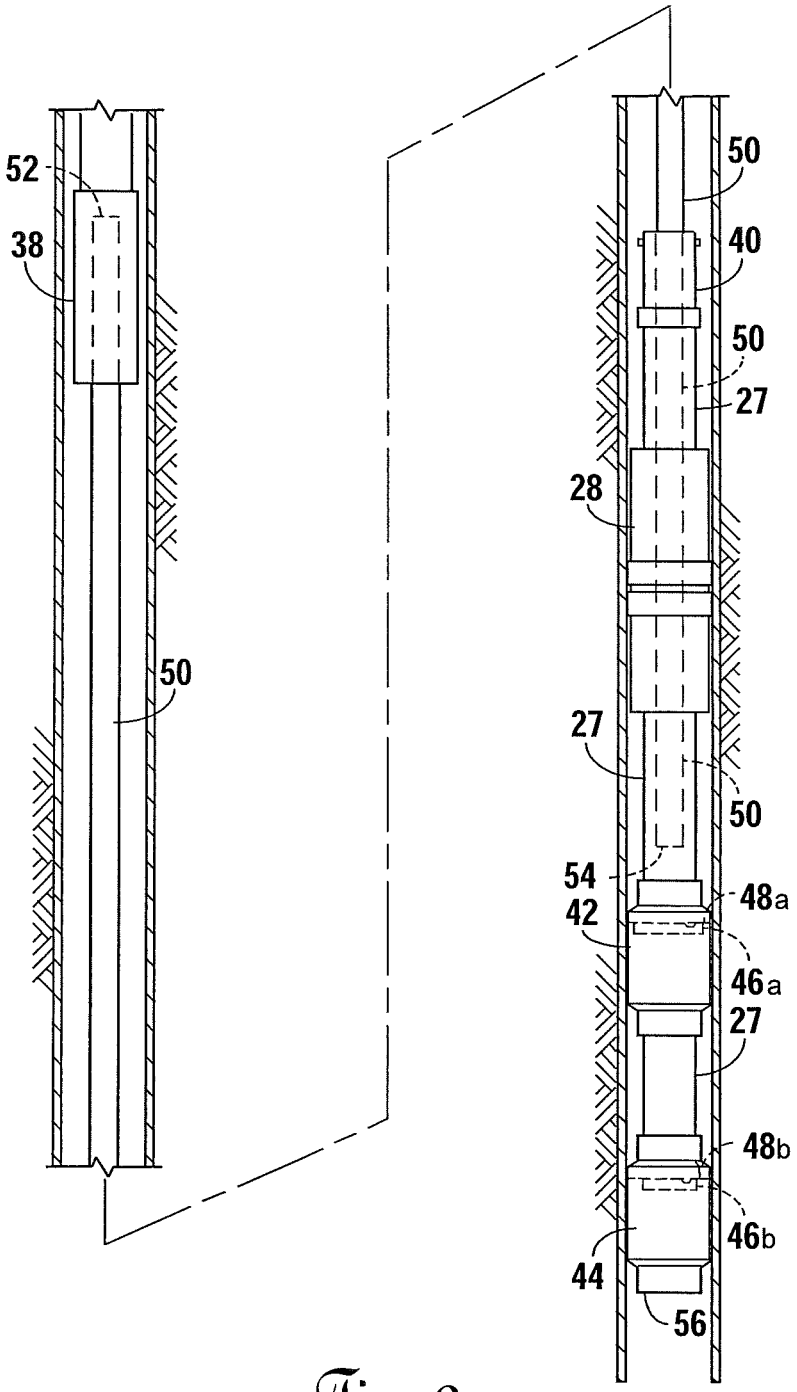

FIG. 3 shows the system described with reference to FIG. 2, but with the overshot 38 having been moved an additional distance upwell from the slick joint 40 to position the second end 54 of the flow tube 50 above the upper flapper assembly 42. This allows the corresponding flapper plate 46*a* to close against the associated seat 48*a*.

Figure 4:
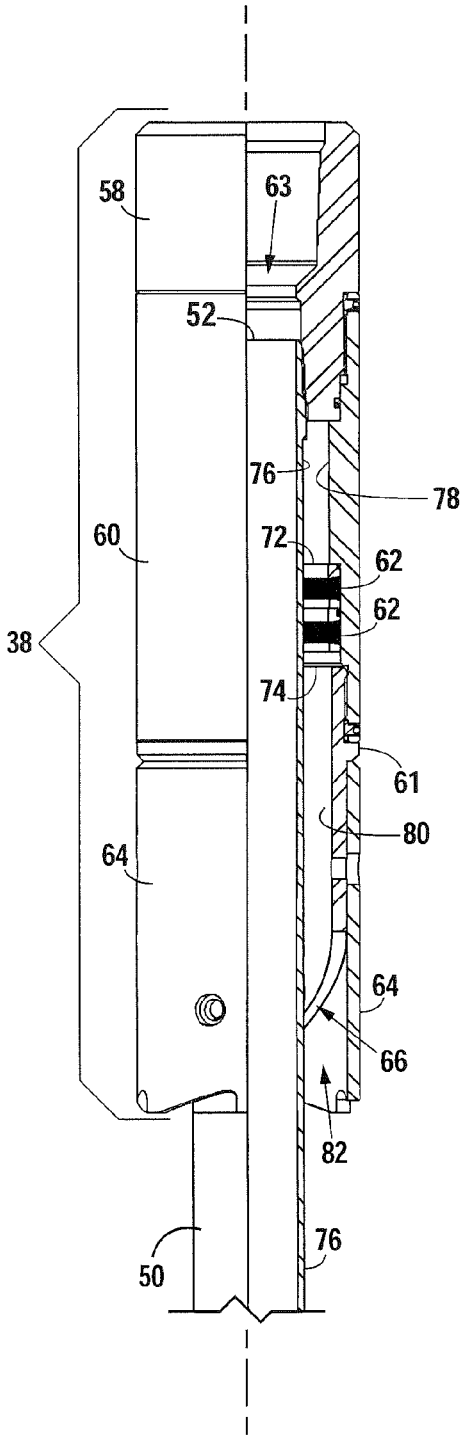
FIG. 4 shows an embodiment of a first part of the tubing disconnect device that may be used with the present invention.

FIG. 4 is an enlarged view of the latch receiving member (i.e., the overshot 38) and flow tube 50 described with reference to FIGS. 1-3. The overshot 38 includes a top sub 58, a seal body 60, a slotted member 61 having J-slots 66 formed therethrough, and a housing 64. The top sub 58 includes a narrowing section 63 having inner threads. The first end 52 of the flow tube 50 is threaded to a narrowing section 63 of the top sub 58 to provide a fluid communication path through the overshot 38.

An annular seal 72 with sealing elements 62 is nested within the seal body 60 and longitudinally fixed between the seal body 60 and an annular surface 74 of the slotted member 61. The cylindrical outer surface 76 of the flow tube 50 and the cylindrical inner surfaces 78, 80 of the seal body 60 and slotted member 61, respectively, define an annular space 82 that may selectively receive the latch member (not shown).

During use, the overshot 38 may by lowered onto the slick joint (not shown), which will occupy the annular space 82. The slick joint includes a latching member, or nipple, fittable into the J-slots 66 formed in the slotted member 61. By manipulating the pressure and rotation of the overshot 38 relative to the slick joint, the latching member may be selectively moved into or out of the J-slots 66 to connect or disconnect these two components of the tubing disconnect device.

Figure 5:
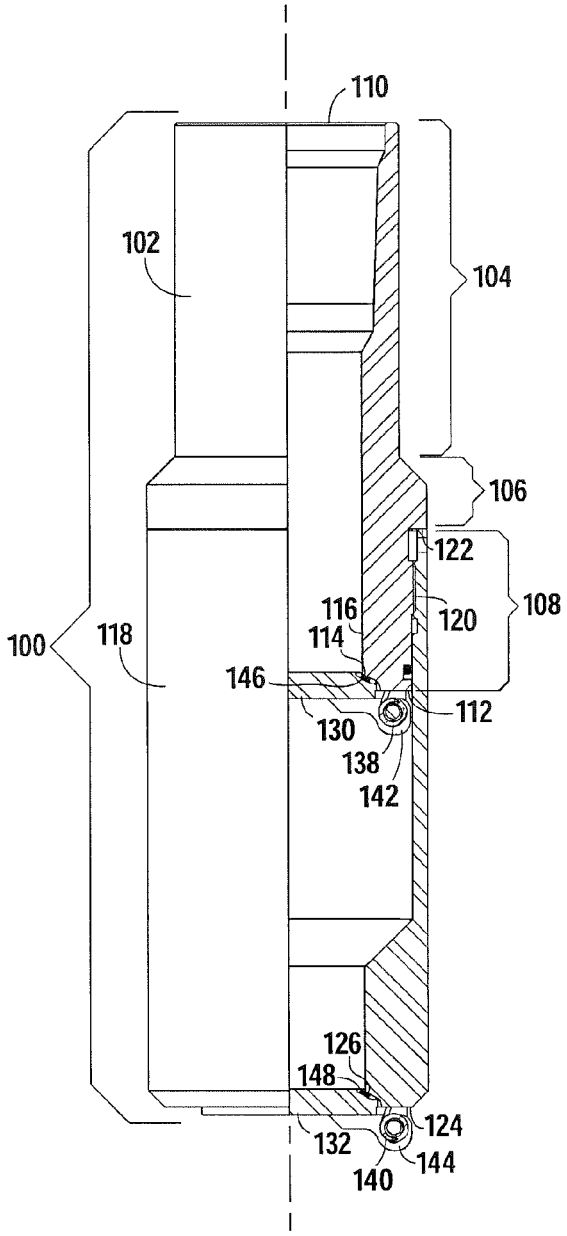
FIG. 5 shows an alternative embodiment of the check valve assemblies of the present invention.

FIG. 5 is a partial sectional view of an alternative embodiment of a flapper assembly 100 that may be used in the system. The flapper assembly 100 comprises a generally-annular first body 102 having annular first and second end surfaces 110, 112. A partially-conical first seat 114 is adjacent to the second end surface 112.

The flapper assembly 100 further comprises an annular second body 118 having a generally-fixed outer diameter and an inner surface 120 with threads engagable with the threads of the first body 102. The second body 118 has annular first and second end surfaces 122, 124. The annular first surface 122 is positioned adjacent to the intermediate second section 106 of the first body 102. A partially-conical second seat 126 is adjacent to the second end surface 124.

First and second flapper plates 130, 132 are connected and rotatable relative to the second end surfaces 112, 124. The first and second flapper plates 130, 132 have first and second partially-conical surfaces 134, 136 (FIG. 6), respectively, corresponding to the first and second seats 114, 126.

First and second torsion springs 138, 140 are fixed around first and second spring mounts 142, 144. The springs 138, 140 urge the first and second flapper plates 130, 132, respectively, towards the first and second bodies 102, 118. First and second partially-conical rubber sealing elements 146, 148 are positioned between the flapper plates 130, 132 and the seats 114, 126.

Figure 6:
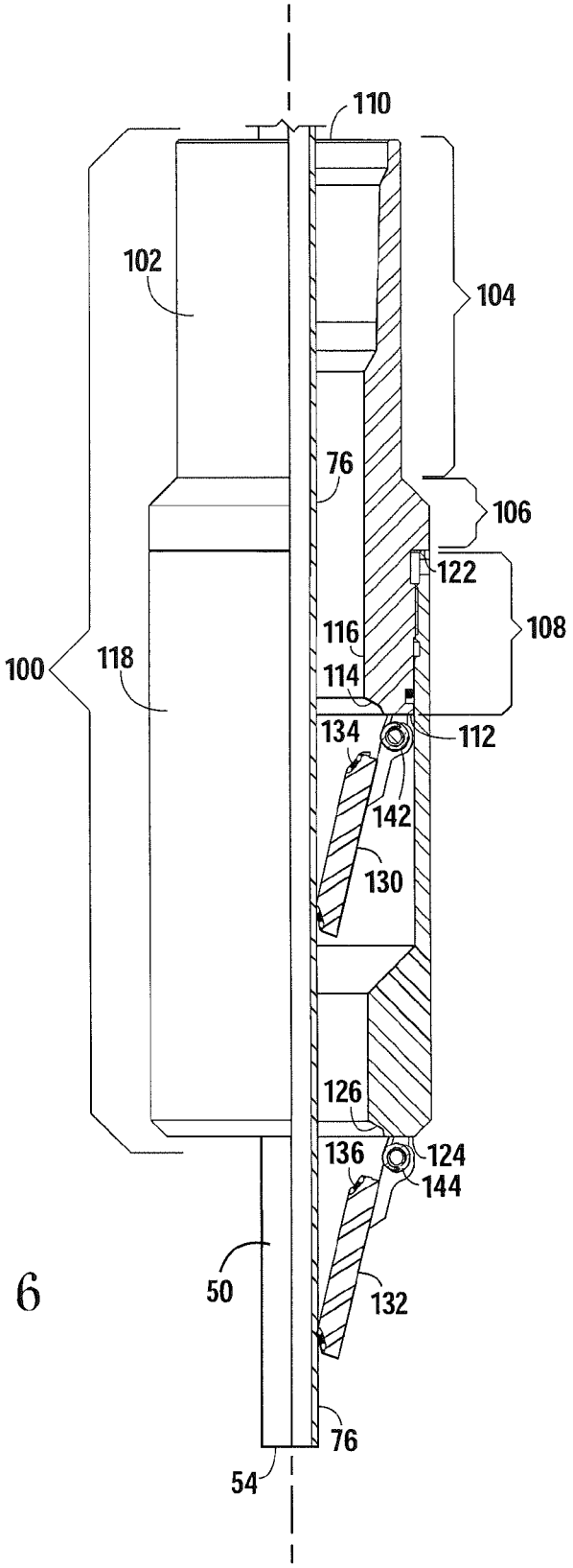
FIG. 6 shows the flapper plates of the check valve assemblies in FIG. 5 in open states and in contact with an outer surface of a flow tube.

FIG. 6 shows the flapper plates 130, 132 of the flapper assembly 100 described with reference to FIG. 5 in opened positions. The flow tube 50 extends through the flow path defined by the first body 102 and the second body 118, and the respective seats 114, 126. The torsion springs 142, 144 urge the flapper plates 130, 132 against the outer surface 76 of the flow tube 50. In this position, injection fluids such as carbon dioxide may be directed out of the second end 54 of the flow tube 50 and into the surrounding formation.

Figure 7:
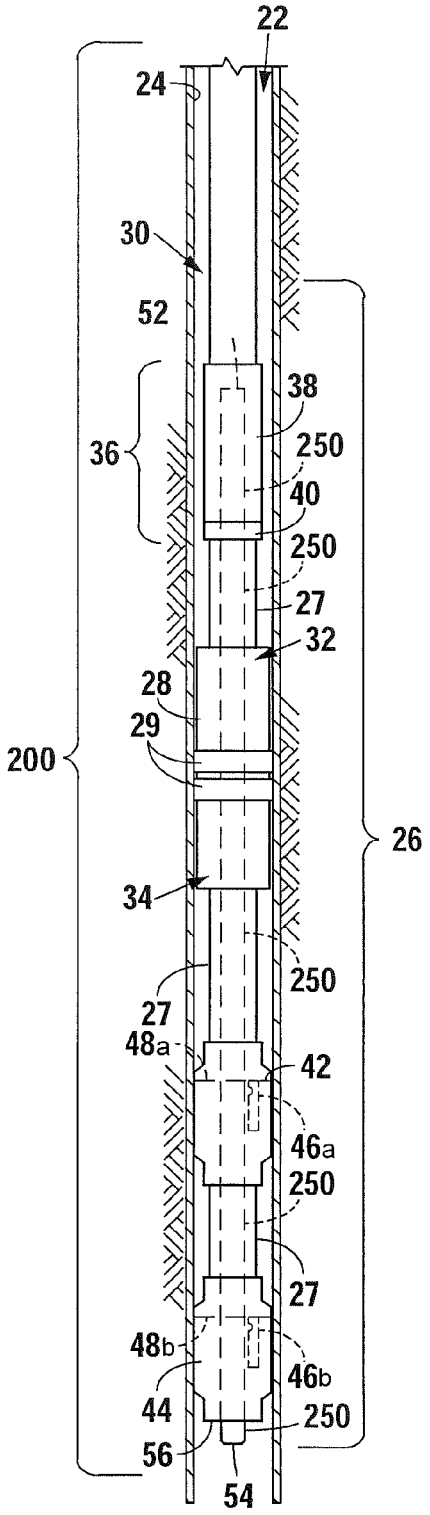
FIG. 7 is a system diagram of an alternative embodiment of the present invention with a wellbore.

FIG. 7 is a system diagram of an alternative embodiment 200 of the present invention within a wellbore, in which reference numbers common to both FIG. 7 and FIG. 1-6 are used for identical elements. In this alternative embodiment 200, a cylindrical rod 250 is connected to the latch receiving member 38 of the tubing disconnect device 36 and extends through the latch element 40 to an operating position.

The rod 250 is a generally elongate rigid member having a first end 252, a second end 254, and a cylindrical outer surface 276. The rod 250 extends from the latch receiving member 38 through tubing segments 27, the packer 28, and the flapper assemblies 42, 44. The second end 254 is positioned approximately two inches below the lower annular surface 256 of the lower flapper assembly 44 and extends through each of the annular seats 48. The first end 252 is connected to the overshot 38. Because the rod 250 is positioned through the flapper assemblies 42, 44, the flapper plates 46*a*, 46*b* cannot rotate to a closed position under the force of the associated springs and are in opened states. The outer surface 276 of the rod 250 partially defines an annular space with the inner surfaces of the tubing disconnect device 36, tubing segments 27, packer 28, and first and flapper assemblies 42, 44.

Figure 8:
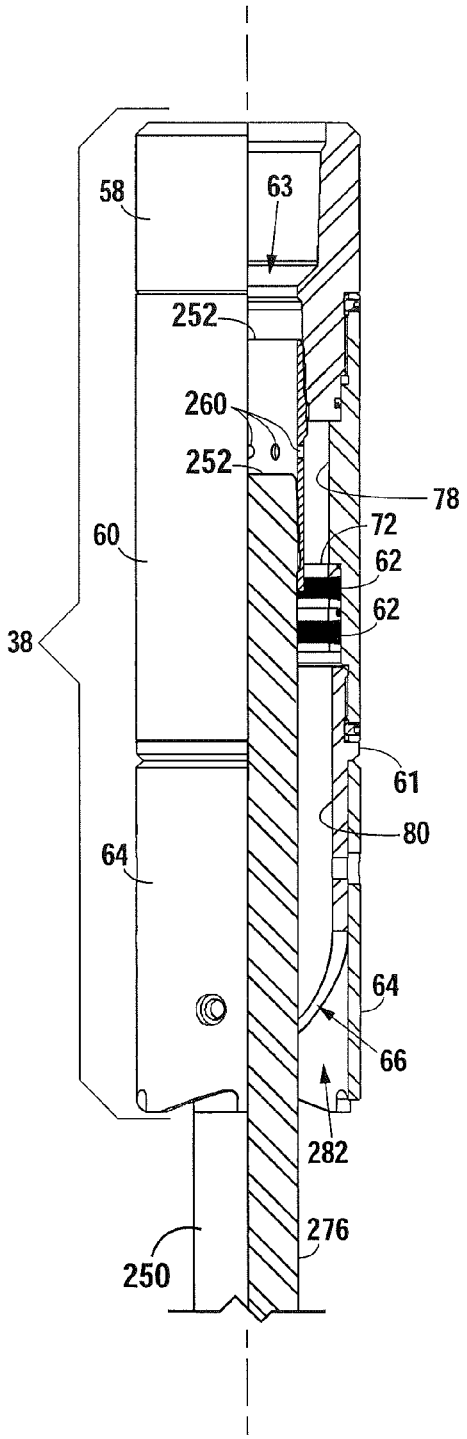
FIG. 8 is an alternative embodiment of a first part of the tubing disconnect device that may be used with the embodiment shown in FIG. 7.

Referring to FIG. 8, the rod 250 is connected to the overshot 38 with a coupling member 260. The coupling member 260 has an outer threaded surface 262 for engagement with the narrowing section 63 of the overshot 38, and a threaded inner surface 264. The first end 252 of the rod 250 is threaded for engagement with the inner surface 264 of the coupling member 260.

The outer surface 276 of the rod 250 and the cylindrical inner surfaces 78, 80 of the seal body 60 and slotted member 61, respectively, define an annular space 282 that may selectively receive the latch member (not shown). A plurality of ports 266 extends between the inner surface 264 and the outer surface 262 and provides a communication path between the overshot 38 and the annular space 282.

The cylindrical outer surface 276 of the rod 250 and the cylindrical inner surfaces 78, 80 of the seal body 60 and slotted member 61, respectively, define an annular space 282 that may selectively receive the latch member (not shown). When used, fluids flowing back to the surface migrate through lower annular surface 56, through the annular space 277 (see FIG. 7), through the annular space 282 to the coupling member 260, and through the radial ports 266 into the overshot 38.

This disclosure describes preferred embodiments in which a specific systems and methods are described. Those skilled in the art will recognize that alternative embodiments of such a system and method can be used in carrying out the present invention. Other aspects and advantages of the present invention may be obtained from a study of this disclosure and the drawings, along with the appended claims.

We claim:

1. A downhole system comprising:

an annulus sealing device having a flow path therethrough, a first side, a second side and at least one sealing element;

a latch element positioned at said first side of said annulus sealing device;

at least one check valve assembly positioned at said second side of said annulus sealing device;

said at least one check valve assembly having an annular seat, a seat-engaging element rotatably relative to said annular seat, and a biasing member urging said seat-engaging element toward said annular seat; and a rigid elongate member extending at least partially through said latch element, said elongate member having a first end, a second end and an outer surface extending between said first end and said second end;

a latch receiving element coupled to the first end of said rigid elongate member and selectively attachable to and detachable from said latch element; and a fluid communication path extending between said annular seat and through said latch element, said fluid communication path at least partially defined by said rigid elongate member;

wherein the second end of said rigid elongate member extends through the at least one check valve to prevent engagement of the seat engagement member with the annular seat.

2. The downhole system of claim 1 wherein said rigid elongate member is a flow tube defining said fluid communication path between said first and said second end.

3. The system of claim 2 wherein said at least one check valve assembly comprises at least one flapper assembly having a seat, a flapper plate rotatable relative to said seat, and a biasing member urging the flapper plate to a closed position.

4. The system of claim 2 wherein the annulus sealing device is a packer.

5. The system of claim 4 wherein the packer is a double grip sealing packer.

6. The system of claim 5 wherein the latch element is a slick joint.

7. The system of claim 2 wherein said seat-engaging element is rotatable relative to said seat between a closed position and an open position, wherein in the closed position the seat-engaging element is engaged with and biased toward the seat element.

8. The system of claim 1 further comprising a latch seal, said latch seal preventing fluid communication through at least a portion of an annular space defined by the elongate tubular body and the latch receiving element.

9. The system of claim 8 wherein said latch receiving element is an overshot.

10. The method of claim 8 wherein the latch seal has a nominal stroke length at least equal to the length of the second end of the rigid elongate member extending through the at least one annular seat.

11. The system of claim 1 wherein said fluid communication path is partially defined by the outer surface of the elongate member.

12. The system of claim 1 wherein the downhole system is installed in a gas injection well.

13. The system of claim 12 where in the system substantially prevents unloading when tubing is removed from the gas injection well.

14. A method of facilitating remedial work in an injection well, the method comprising the steps of:

running a downhole system in a wellbore having a sidewall, the downhole system comprising:

an annulus sealing device having a flow path therethrough, a first side, a second side, and at least one sealing element;

a tubing disconnect device having a first part disconnectable from a second part, the tubing disconnect device positioned at said first side of said annulus sealing device, at least one check valve assembly positioned at said second side of said annulus sealing device, said at least one check valve assembly having an annular seat, a seat-engaging element rotatably movable relative to said annular seat, and a biasing member urging said seat-engaging element toward said annular seat;

a rigid elongate member having a first end connected to said tubing disconnect device, a second end, and an outer surface extending between said first end and said second end; and a fluid communication path extending between said annular seat and said tubing disconnect device, said fluid communication path at least partially defined by said rigid elongate member;

setting the annulus sealing device in the wellbore against the sidewall;

separating the tubing disconnect device;

moving the first part of the tubing disconnect device relative to the second part of the tubing disconnect device until the elongate member does not occupy the seats of the at least one check valve assembly;

performing remedial work on equipment in the tubing string above the system; and moving the first part of the tubing disconnect device relative to the second part of the tubing disconnect device causing a seal in the tubing disconnect device to isolate the fluid communication path from the exterior of the tubing disconnect device; and occupying the seats of the at least one check valve assembly with the elongate member after the causing step.

15. The method of claim 14 wherein said rigid elongate member is a flow tube defining said fluid communication path between said first end and said second end, and said running step comprises:

a first running step of disposing said second part of said tubing disconnect device, the annulus sealing device, and said at least one check valve assembly into the wellbore;

a second running step of disposing said first part of the tubing disconnect device and said flow tube to an operating position; and wherein in the operating position the second end of the flow tube is downwell of said at least one check valve assembly.

16. The method of claim 15 wherein said first part of said tubing disconnect device is an overshot and said second part of said tubing disconnect device is a slick joint.

17. The method of claim 14 wherein said fluid communication path is partially defined by the outer surface of the elongate member.

18. The method of claim 14 further comprising injecting gas through the downhole system into well, thereby increasing reservoir pressure, wherein said injecting step is performed both before and after the remediating step.

19. A downhole system comprising:

an annulus sealing device having a flow path therethrough, a first side, a second side, and at least one sealing element;

an annular landing shoulder positioned at said first side of said annulus sealing device;

at least one check valve assembly positioned at said second side of said annulus sealing device, said at least one check valve assembly having an annular seat, a seat-engaging element rotatably movable relative to said annular seat, and a biasing member urging said seat-engaging element toward said annular seat; and a rigid elongate member extending at least partially through said landing shoulder, said elongate member having a first end, a second end, and an outer surface extending between said first end and said second end;

a latch seal, said latch seal preventing fluid communication through at least a portion of an annular space defined by the elongate tubular body and the latch receiving element; and a fluid communication path extending between said annular seat and through said landing shoulder, said fluid communication path at least partially defined by said rigid elongate member.

20. The system of claim 19 wherein the latch seal has a nominal stroke length at least equal to the length of the portion of the rigid elongate member extending through the at least one annular seat.

* * * * *